US009033156B2

(12) United States Patent
Burkhard

(10) Patent No.: US 9,033,156 B2
(45) Date of Patent: May 19, 2015

(54) ELECTROMAGNETIC SEPARATION FOR SHAKERS

(75) Inventor: Alan Wayne Burkhard, Fort Thomas, KY (US)

(73) Assignee: M-I L.L.C., Houston, TX (US)

( * ) Notice: Subject to any disclaimer, the term of this patent is extended or adjusted under 35 U.S.C. 154(b) by 1037 days.

(21) Appl. No.: 11/961,684

(22) Filed: Dec. 20, 2007

(65) Prior Publication Data

US 2008/0149537 A1 Jun. 26, 2008

Related U.S. Application Data

(60) Provisional application No. 60/871,215, filed on Dec. 21, 2006.

(51) Int. Cl.
*B07B 1/42* (2006.01)

(52) U.S. Cl.
CPC ..... *B07B 1/42* (2013.01)

(58) Field of Classification Search
USPC ..... 209/368, 364–365.4, 404, 405, 409, 209/413; 198/769
See application file for complete search history.

(56) References Cited

U.S. PATENT DOCUMENTS

| | | | | |
|---|---|---|---|---|
| 935,216 | A * | 9/1909 | Villars et al. | 209/347 |
| 2,077,678 | A * | 4/1937 | Delamater | 209/346 |
| 2,109,395 | A * | 2/1938 | Markley | 209/326 |
| 2,333,338 | A * | 11/1943 | Rapp | 198/609 |
| 2,746,598 | A * | 5/1956 | Sherwen | 198/769 |
| 3,495,710 | A * | 2/1970 | Egorenkov et al. | 209/368 |
| 5,045,184 | A * | 9/1991 | Arkles | 209/405 |
| 5,100,539 | A * | 3/1992 | Tsutsumi | 209/240 |
| 5,205,395 | A * | 4/1993 | Bruno et al. | 198/389 |
| 5,582,727 | A | 12/1996 | Foster | |
| 5,647,477 | A * | 7/1997 | Morishita | 198/619 |
| 7,571,817 | B2 * | 8/2009 | Scott et al. | 209/413 |
| 8,261,687 | B2 * | 9/2012 | Kim et al. | 118/309 |
| 2003/0201237 | A1 | 10/2003 | Grichar et al. | |
| 2003/0230526 | A1 | 12/2003 | Okabayshi et al. | |
| 2005/0242009 | A1 | 11/2005 | Padalino et al. | |
| 2006/0243643 | A1 | 11/2006 | Scott et al. | |
| 2008/0029368 | A1 * | 2/2008 | Komori | 198/619 |

OTHER PUBLICATIONS

PCT International Search Report issued in PCT Application No. PCT/US2007/088566 dated Mar. 25, 2008 (3 pages).
PCT Written Opinion issued in PCT Application No. PCT/US2007/088566 dated Mar. 25, 2008 (3 pages).
Examination Report issued in related British Application No. GB0911701.1; dated Nov. 23, 2010 (2 pages).
Examination Report issued in corresponding British Patent Application No. GB0911701.1; Dated Jul. 18, 2011 (1 page).

* cited by examiner

*Primary Examiner* — Joseph C Rodriguez
(74) *Attorney, Agent, or Firm* — Osha Liang LLP

(57) ABSTRACT

A vibratory separator including a skid having a skid magnet and a basket having a basket magnet disposed on the basket, wherein the skid magnet and the basket magnets are arranged to magnetically interact. Also, a method for operating a vibratory separator that includes supplying a current to a skid electromagnet disposed on a skid of the vibratory separator, and interacting the skid electromagnet with a basket magnet disposed on a basket of the vibratory separator.

21 Claims, 7 Drawing Sheets

ELECTROMAGNETIC SEPARATION FOR SHAKERS

CROSS-REFERENCE TO RELATED APPLICATIONS

This application, pursuant to 35 U.S.C. §119(e), claims priority to U.S. Provisional Application Ser. No. 60/871,215, filed Dec. 21, 2006. That application is incorporated by reference in its entirety.

FIELD OF DISCLOSURE

In general, embodiments of the present disclosure relate to apparatuses and methods for separating solids from liquids. More specifically, embodiments of the present disclosure relate to apparatuses and methods for levitating a part of a vibratory separator and/or imparting a vibratory motion thereon.

BACKGROUND

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures thereby preventing fluids from blowing out if pressurized deposits in the formation are breeched. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and repumped down through nozzles of the drill bit, the cutting particulates must be removed.

Apparatus in use today to remove cuttings and other solid particulates from drilling fluid are commonly referred to in the industry as shale shakers or vibratory separators. A vibratory separator is a vibrating sieve-like table upon which returning solids laden drilling fluid is deposited and through which clean drilling fluid emerges. Typically, the vibratory separator is an angled table with a generally perforated filter screen bottom. Returning drilling fluid is deposited at the feed end of the vibratory separator. As the drilling fluid travels down length of the vibrating table, the fluid falls through the perforations to a reservoir below leaving the solid particulate material behind. The vibrating action of the vibratory separator table conveys solid particles left behind until they fall off the discharge end of the separator table. The above described apparatus is illustrative of one type of vibratory separator known to those of ordinary skill in the art. In alternate vibratory separators, the top edge of the separator may be relatively closer to the ground than the lower end. In such vibratory separators, the angle of inclination may require the movement of particulates in a generally upward direction. In still other vibratory separators, the table may not be angled, thus the vibrating action of the separator alone may enable particle/fluid separation. Regardless, table inclination and/or design variations of existing vibratory separators should not be considered a limitation of the present disclosure.

Preferably, the amount of vibration and the angle of inclination of the vibratory separator table are adjustable to accommodate various drilling fluid flow rates and particulate percentages in the drilling fluid. After the fluid passes through the perforated bottom of the vibratory separator, it can either return to service in the borehole immediately, be stored for measurement and evaluation, or pass through an additional piece of equipment (e.g., a drying shaker, centrifuge, or a smaller sized shale shaker) to further remove smaller cuttings.

A typical vibratory separator consists of an elongated, box-like, rigid bed, and a screen attached to, and extending across, the bed. The bed is vibrated as the material to be separated is introduced to the screen. The vibrations, often in conjunction with gravity, move the relatively large size material along the screen and off the end of the bed. Liquid and/or relatively small sized material passes through the screen into a pan. The bed is typically vibrated by pneumatic, hydraulic, or rotary vibrators, in a conventional manner.

FIG. 1 shows a conventional vibratory shaker 1. Vibratory shaker 1 has a screen assembly 2 mounted in a vibratable screen mounting apparatus known as a basket 3. Screen assembly 2 may be of any type known to one of ordinary skill in the art including, for example, hookstrip or pretensioned. Basket 3 is mounted on four springs 4, two of which are shown, the other two of which are on the opposite side of basket 3. Additionally, four basket spring pads 9 are positioned on top of springs 4. Springs 4 are supported on four skid spring pads 10 disposed on a skid 6. Basket 3 is vibrated by a motor 5 and interconnected vibrating apparatus 8 which is mounted on basket 3 for vibrating basket 3 and screen 2. Elevator apparatus 7 provides for raising and lowering of basket 3 at one end.

Mounting basket 3 on springs 4 attached to skid 6 allows for a vibratory motion to be imparted to basket 3 relative to skid 6. However, heavy loads, including basket 3 and drilling material disposed thereon, may have to be supported by springs 4, and thus, springs 4 may be very rigid and resistant to movement. Such rigidity may result in requiring high forces in order to impart a vibratory motion to basket 3. Furthermore, applied energy may be lost to friction in springs 4, necessitating additional energy to impart vibratory motions. Also, springs 4 may become less rigid through use, diminishing the capability of springs 4 to function as expected. Thus, springs 4 may require maintenance and will eventually require replacement.

Accordingly, there exists a need for a vibratory shaker that may be constructed with more wear-resistant parts. Furthermore, there exists a need for a vibratory shaker having a basket that may be suspended above a skid without attachment through a rigid member, thereby vibrated by non-conventional methods.

SUMMARY OF THE DISCLOSURE

In one aspect, embodiments disclosed herein relate to a vibratory separator that includes a skid having a skid magnet and a basket having a basket magnet disposed on the basket, wherein the skid magnet and the basket magnets are arranged to magnetically interact.

In another aspect, embodiments disclosed herein relate to a method for operating a vibratory separator that includes supplying a current to a skid electromagnet disposed on a skid of the vibratory separator, and interacting the skid electromagnet with a basket magnet disposed on a basket of the vibratory separator.

Other aspects and advantages of the disclosure will be apparent from the following description and the appended claims.

DETAILED DESCRIPTION

In the following detailed description of embodiments of the present disclosure, numerous specific details are set forth in order to provide a more thorough understanding of the present disclosure. However, it will be apparent to one of ordinary skill in the art that the present disclosure may be practiced without these specific details. In other instances, well-known features have not been described in detail to avoid unnecessarily complicating the description.

Generally, embodiments of the present disclosure relate to apparatuses and methods for separating solids from liquids. Specifically, embodiments of the present disclosure relate to apparatuses and methods for levitating a part of a vibratory separator and/or imparting a vibratory motion thereon.

Figure 2:
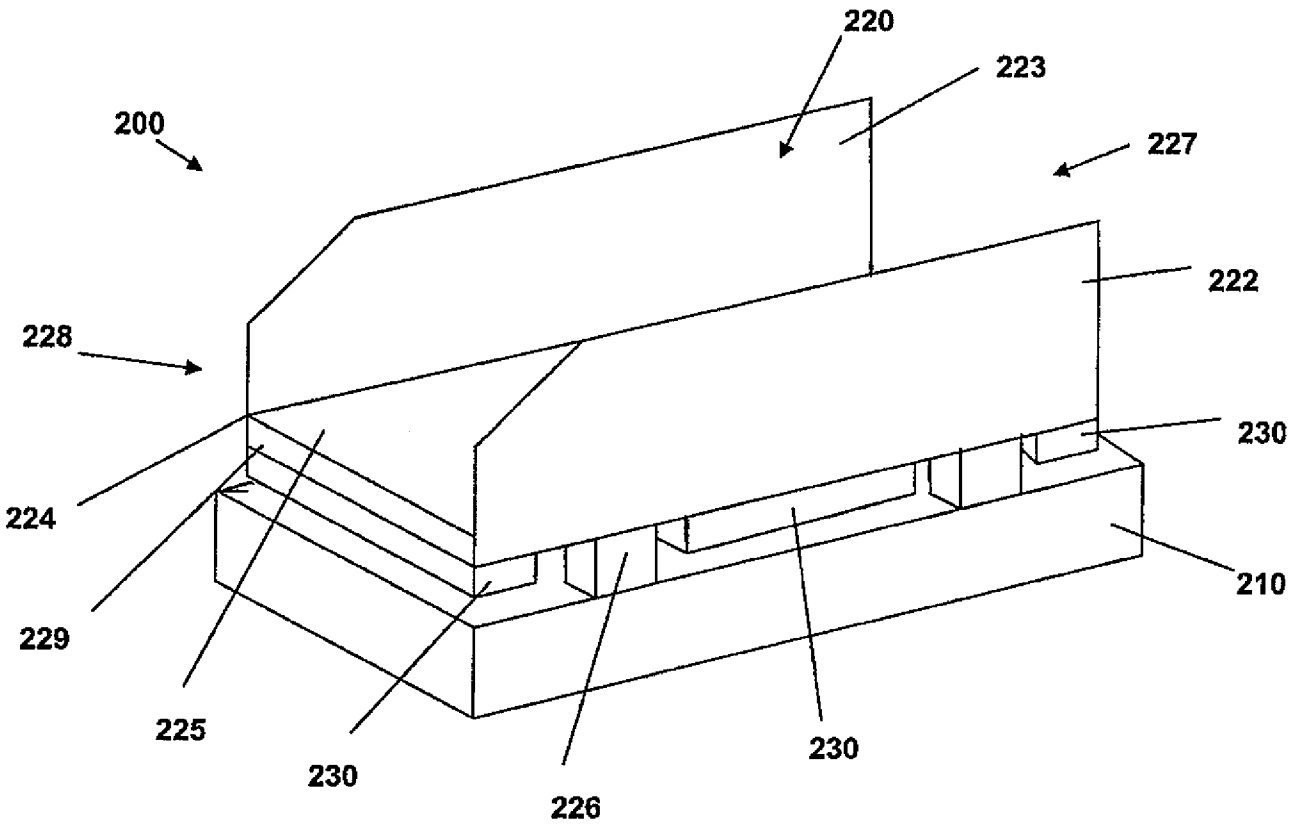
FIG. 2 shows a perspective view of a vibratory separator at rest in accordance with an embodiment of the present disclosure.
Figure 3:
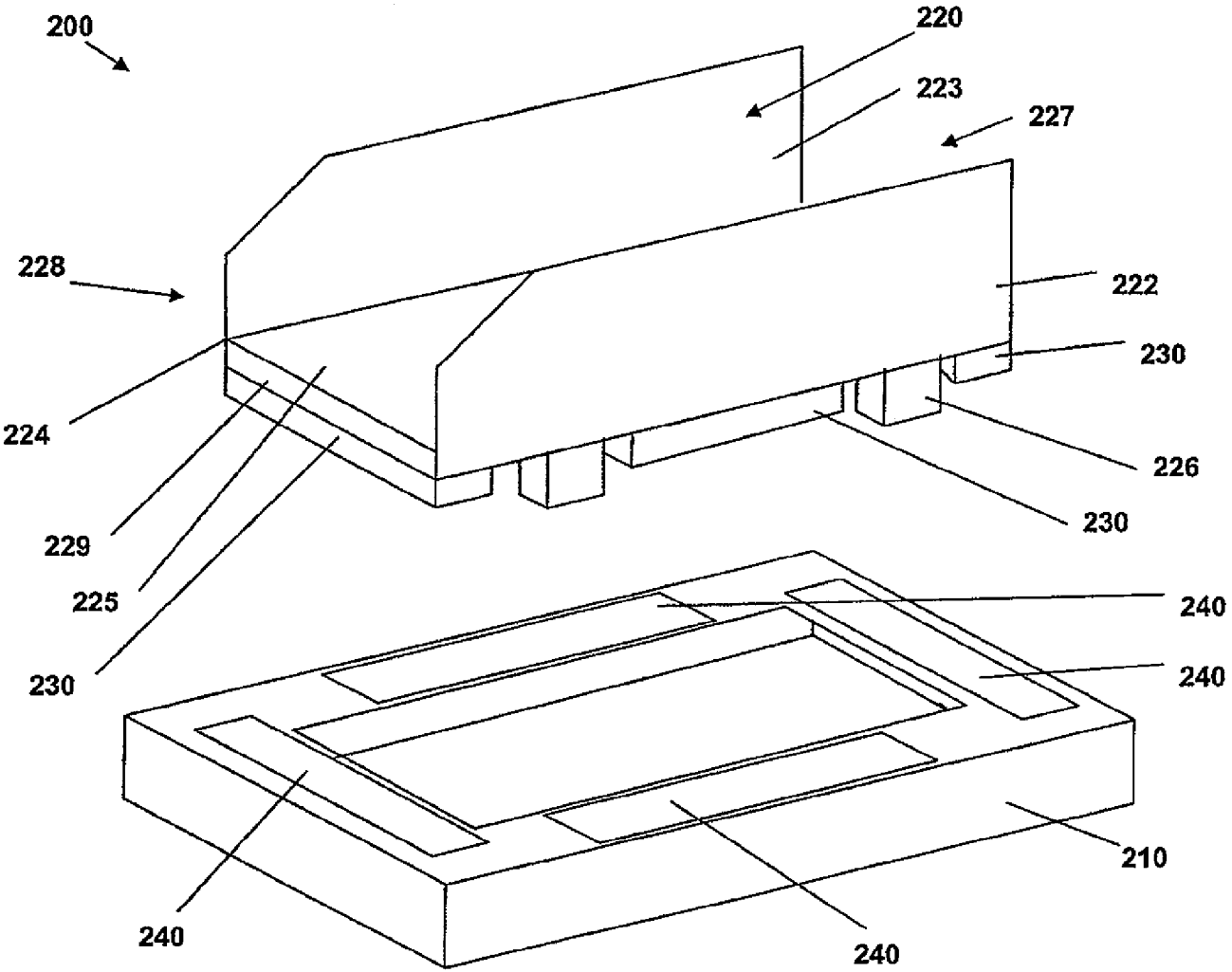
FIG. 3 shows a perspective view of a vibratory separator during operation in accordance with an embodiment of the present disclosure.

FIGS. 2 and 3 show a vibratory separator 200 in accordance with embodiments of the present disclosure. Vibratory separator 200 may include a skid 210 providing a base for vibratory separator 200. Also, vibratory separator 200 may include a basket 220 having sidewalls 222, 223, and a bed frame 224. Bed frame 224 may include a screen 225 mounted thereon. Furthermore, basket 220 may include a pan 229 to collect fluid falling through screen 225, and basket 220 may include legs 226 by which basket 220 rests on skid 210.

One or more permanent magnets 230 may be disposed on any surface of basket 220. In an embodiment shown in FIGS. 2 and 3, permanent magnets 230 are disposed around a periphery of a bottom surface of basket 220. Specifically, permanent magnets 230 are disposed along the front, back, and side edges of the bottom surface of basket 220. Turning to skid 210, one or more electromagnets 240 may be disposed to any surface thereon. Furthermore, electromagnets 240 may be disposed opposite of permanent magnets 230. Thus, in the embodiment shown in FIGS. 2 and 3, electromagnets 240 are disposed along the front, back, and side edges, on a periphery of a top surface of skid 210.

Techniques of making electromagnets 240 are well known in the art. Generally, electromagnets may include a core made of paramagnetic or ferromagnetic material, such as iron, and a coil wound around the core. The coil may include a wire made of a conductive material, such as copper. A flow of electric current produces a magnetic field, and when the current ceases, the magnetic field is no longer produced. Additionally, a mounting surface of a magnet may include an insulation layer between the magnet and the object on which the magnet is mounted.

Accordingly, a current may be applied to electromagnets 240, which produces a magnetic field. In the embodiment shown in FIG. 2, no current is applied to electromagnets 240, and no significant magnetic forces exist between electromagnets 240 and permanent magnets 230. Thus, basket 220 is at rest on skid 210. Legs 226 may provide clearance between basket 220 and skid 210, to reduce the risk of damage. As illustrated in FIG. 3, a current may be applied to electromagnets 240, generating repulsive magnetic forces between electromagnets 240 and permanent magnets 230. Such repulsive forces may lift basket 220 away from skid 210. Accordingly, an applied current may be controlled such that basket 220 levitates above skid 210. In some embodiments, the height of levitation of basket 220 may range from a few millimeters to a few centimeters. Furthermore, a current may be applied such that a vibratory motion is imparted to basket 220.

Vibratory separator 200 may operate in a manner similar to conventional vibratory separators. Generally, a current may be applied to electromagnets 240 such that basket 220 may be suspended above skid 210. Further, a vibratory motion may be imparted to basket 220. Drilling material may enter vibratory separator 200 at an inlet end 227, wherein drilling material may be disposed on top of screen 225. Vibratory motion may therein convey drilling material along screen 225 toward an outlet end 228. As drilling material is conveyed along screen 225, fluids and particulate matter may collect in pan 229. Alternatively, basket 220 may not include pan 229, and fluids may fall toward skid 210 for collection. After separation, solids and/or cleaned drill cuttings may be discharged through outlet end 228. Outlet end 228 may extend beyond other parts of basket 220 or skid 210 such that solid drilling material may fall outside of vibratory separator 200. Those skilled in the art will appreciate that other collection and discharge methods may be used, and as such, are within the scope of the present disclosure.

Those skilled in the art will recognize the above description of placing magnets on a basket and a skid, levitating the basket, and imparting a vibratory motion to the basket only describes one embodiment of the present disclosure. Accordingly, any part of a vibratory separator may be levitated, and any part of a vibratory separator may have a vibratory motion imparted thereon.

Figure 1:
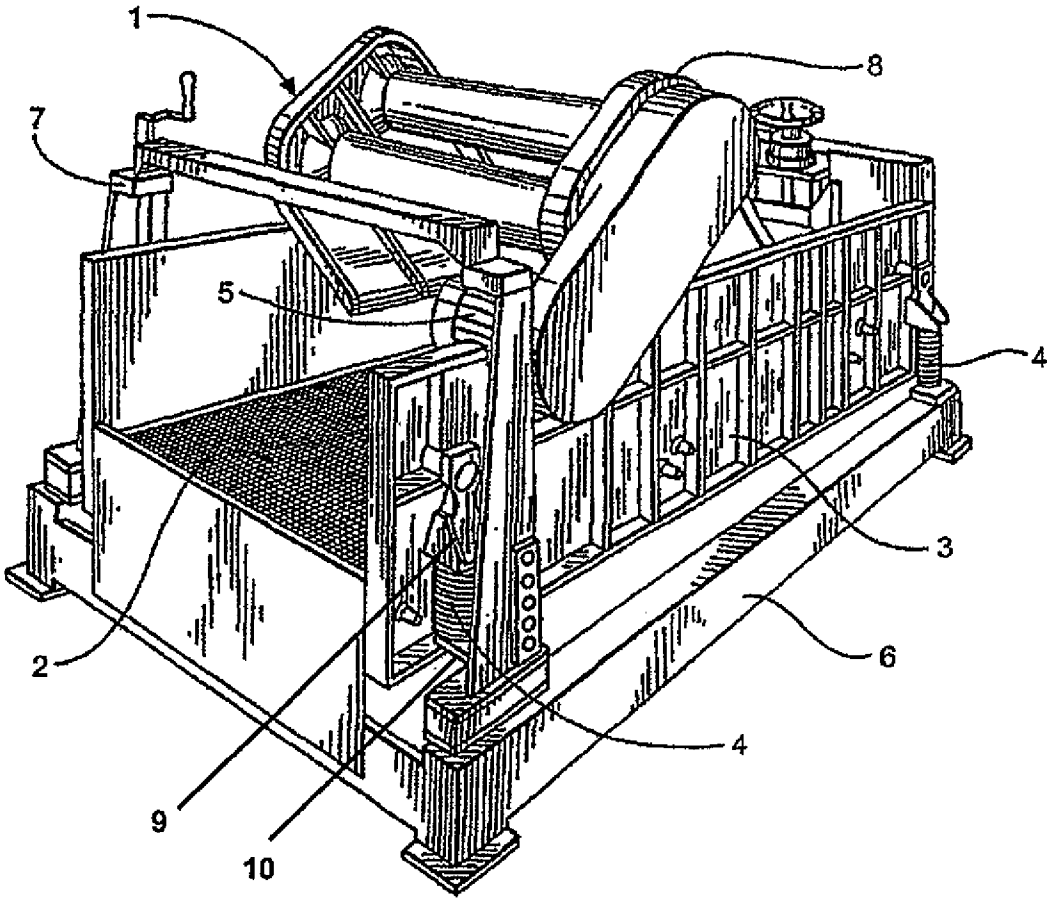
Fig. 1 Prior Art
FIG. 1 shows a prior art vibratory shaker.

One or more embodiments of the present disclosure may include a vibratory separator having spring pads as discussed with reference to FIG. 1. Spring pads may be disposed on any surface of the basket or skid between a support structure of the vibratory separator and the magnets. Such embodiments may have magnets mounted on the spring pads instead of springs, thereby replacing the structure and function of the springs.

Figure 4:
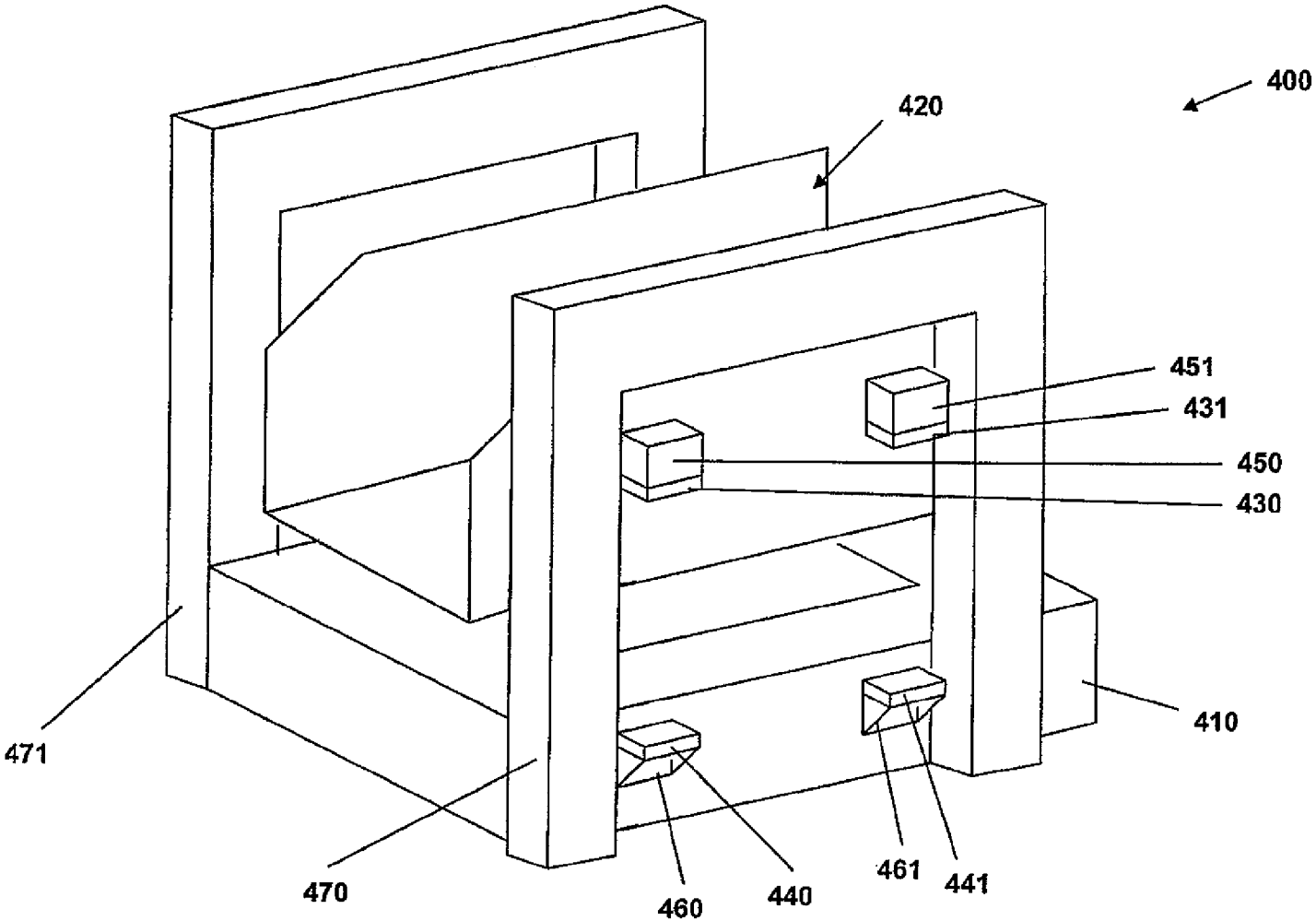
FIG. 4 shows a perspective view of a vibratory separator with spring pads in accordance with an embodiment of the present disclosure.

Referring now to FIG. 4, a vibratory separator 400 in accordance with an embodiment of the present disclosure is shown. Vibratory separator 400 may include a basket 420 with basket spring pads 450, 451 disposed on one or more sides of basket 420. Basket spring pads 450, 451 may have permanent magnets 430 and 431 disposed on a bottom surface of basket spring pads 450 and 451, respectively. Basket 420 may her include basket spring pads on the opposite side of basket 420, with permanent magnets disposed thereon (not shown). Furthermore, vibratory separator 400 may include a skid 410, which may include skid spring pads 460, 461 disposed on a side of skid 410. Skid spring pads 460, 461 may have electromagnets 440 and 441 disposed on a top surface of skid spring pads 460 and 461, respectively. Skid 410 may further include skid spring pads on the opposite side of skid 410, with electromagnets disposed thereon (not shown).

Vibratory separator 400 may function in a manner similar to vibratory separator 200 of FIGS. 2 and 3. Specifically, a current may be applied to electromagnets 440, 441, generating repulsive magnetic forces between electromagnets 440, 441 and permanent magnets 430, 431. The generated repulsive forces may thereby lift basket 420 from skid 410, allowing basket 420 to levitate above skid 410. Furthermore, in some embodiments the current may be controlled such that a vibratory motion is imparted to basket 420.

Figure 5:
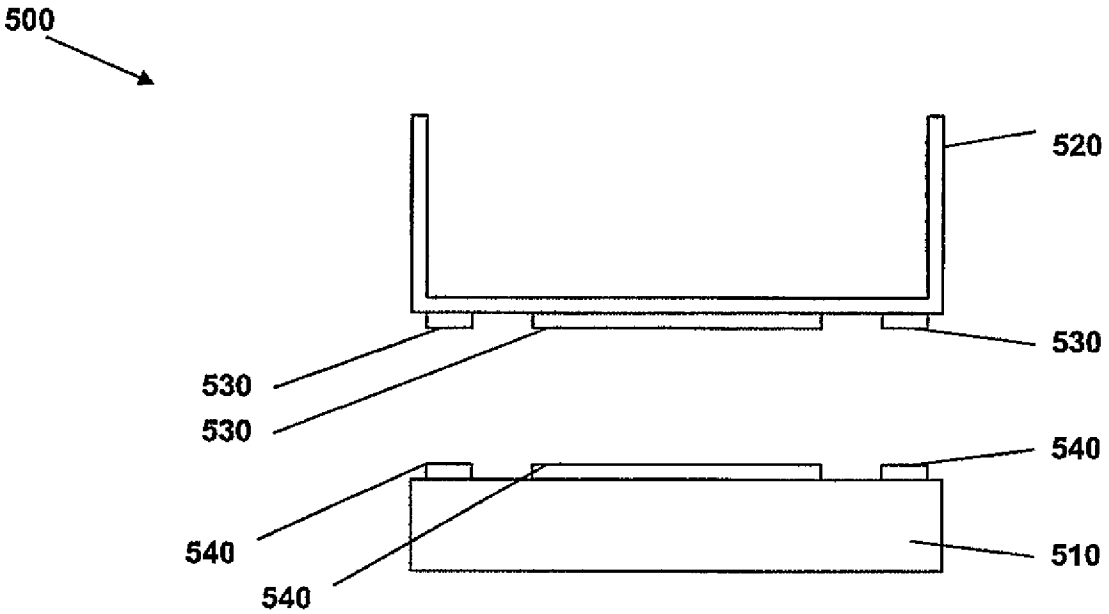
FIG. 5 shows a front view of a vibratory separator in accordance with an embodiment of the present disclosure.

FIG. 5 shows a vibratory separator 500 in accordance with one or more embodiments of the present disclosure. Vibratory separator 500 may be similar to vibratory separator 200 in FIGS. 2 and 3. Similarly, vibratory separator has a skid 510 and a basket 520. As illustrated, vibratory separator 500 includes a plurality of basket magnets 530 disposed on a bottom surface of basket 520. Basket magnets 530 may be any combination of magnets (e.g., permanent magnets and electromagnets). Furthermore, vibratory separator 500 includes a plurality of skid magnets 540 disposed on a top surface of skid 510. Skid magnets 540 may also be any combination of magnets. While the magnets are illustrated disposed relative to a top surface of skid 510 and a bottom surface 520, in other embodiments, basket magnets 530 and skid magnets 540 may be disposed on any surface of respective vibratory separator components and configured to interact with one another. For example, basket magnets 530 may be disposed on a side surface of basket 520 and skid magnets 540 may be disposed on a side surface of skid 510. Furthermore, because permanent magnets may experience demagnetization over time, in some embodiments, basket magnets 530 and skid magnets 540 may include only electromagnets.

Permanent magnets included in basket magnets 530 may have like polarities facing downward. For example, basket magnets 530 may be arranged such that the north poles of basket magnets 530 all face downward toward skid 510. Similarly, if permanent magnets are included in skid magnets 540, then such magnets may have like polarities facing upward. For example, skid magnets 540 may be arranged such the north poles of skid magnets 540 all face upward toward basket 520. Thus, a repulsive force may be generated between the permanent magnets of skid 510 and basket 520. Furthermore, basket magnets 530 or skid magnets 540 may be arranged such that the polarities are substantially opposite. For example, basket magnets 530 may be arranged such that some of basket magnets 530 have north poles facing downward and some of basket magnets 530 have south poles facing downward. Such an arrangement may be used to provide a certain vibratory motion, which is discussed in detail below. One of ordinary skill in the art will appreciate that different configurations of basket and skid mounted magnets may be used so long as magnetic forces repel the basket away from the skid.

Different currents may be applied to electromagnets in embodiments of the present disclosure. Specifically, alternating currents (AC currents), direct currents (DC currents), or any combination thereof may be applied to electromagnets in accordance with embodiments disclosed herein. Referring back to FIGS. 2 and 3, a DC current may be applied to electromagnets 240, such that poles of electromagnets 240 repel the poles of permanent magnets 230. Thus, a steady repulsive force may be generated between electromagnets 240 and permanent magnets 230.

Alternatively, an AC current may be applied to electromagnets 240. When an AC current is applied to an electromagnet, the poles of the electromagnet alternate as the current alternates. Thus, when an AC current is applied to electromagnets 240, attractive forces may be generated between electromagnets 240 and permanent magnets 230 for half of a cycle, and repulsive forces may be generated between electromagnets 240 and permanent magnets 230 for the other half of the cycle. Over time, the alternating attractive and repulsive forces may impart a vibratory motion to basket 220. The attractive and repulsive forces may be directed in a specified direction (e.g., vertical, horizontal, or angular) such that a vibratory motion is produced. Furthermore, such a vibratory motion may be imparted in addition to vibratory motions produced by other methods (e.g., by motors or magnet systems). Accordingly, one of ordinary skill in the art will appreciate that embodiments described herein may provide a primary or a secondary method of supplying, for example, a vibratory motion, a levitating motion, or a vibratory profile, so as to separate drilling fluids from solids.

Another alternative is to apply a combination of DC and AC currents to electromagnets 240. The application of a DC current in addition to an AC current may cause additional magnetic flux in the core of electromagnets 240. Such a bias may increase the magnetic force generated in one half of a cycle. Thus, an applied current may create more repulsive forces than attractive forces. Furthermore, the same current need not be applied to each of electromagnets 240. Rather, different currents may be applied to each electromagnet 240, thereby providing a desired type of levitation or vibration. As such, one skilled in the art will appreciate that any combination of currents may be applied to any combination of electromagnets 240.

Moreover, those skilled in the art will appreciate that a current may be supplied by any current source known in the art, and will further appreciate that more than one current source may be used to supply current to electromagnets. As such, in one or more embodiments of the present disclosure, a variable frequency drive (VFD) may be used to supply an AC current. As previously discussed, such an AC current may be used to impart a vibratory motion to basket 220.

Many vibratory profiles are known in the art that may be imparted on a basket of a vibratory separator by applying one or more currents to electromagnets located on any surface of the basket. For example, linear vibratory motions or elliptical vibratory motions may be imparted on basket 220. Furthermore, a programmable logic controller may provide instructions to one or more current sources or control systems. The instructions may include vibratory motion protocols that define a pattern of movement for moving components of the vibratory separator. Referring again to FIGS. 2 and 3, by controlling one or more current sources and applying one or more currents to electromagnets 240, a desired vibratory motion may be imparted to basket 220. More specifically, AC or DC currents may be applied to electromagnets 240 to impart a vibratory motion to basket 220. Also, AC and DC currents may be applied in combination to one or more of electromagnets 240. Such currents may be applied individually, or currents may be superimposed and applied to one or more of electromagnets 240.

For example, a single AC current may be continuously applied to electromagnets 240 to impart a steady vibratory motion to basket 240. Additionally, a VFD may supply an AC current with any frequency such that a vibratory motion having a specified frequency is imparted on basket 240. Furthermore, a plurality of VFD's may supply a plurality of AC currents such that a plurality of AC currents having different frequencies may be applied to electromagnets 240. Such currents may be applied to one or more of electromagnets 240 in a staggered manner, or at certain time intervals, to impart a specified vibratory motion to basket 220. Supplied currents may also vary in amplitude such that magnetic forces generated may be varied, thereby providing a desired vibratory motion. Further methods and apparatuses using vibratory motion are disclosed in co-pending U.S. Provisional Application Ser. No. 60/871,379, filed Dec. 21, 2006, titled Magnetic Coupling for Shaker Motion Without Motors, by Alan Burkhard, herein incorporated by reference in its entirety.

The amplitudes of applied currents may vary such that a part of basket 220 may levitate higher or lower than another part of basket 220. For example, a greater levitating force may be applied to an outlet end 228 of basket 220 than an inlet end 227 of basket 220, thus levitating outlet end 228 higher than inlet end 227. This embodiment may increase the time it takes for drilling material to move from inlet end 227 to outlet end 228. Such an embodiment may result in a longer vibratory process, thereby providing drier cuttings and a greater recapture of fluids. Similarly, inlet end 227 may be levitated at a greater height than outlet end 228, thus decreasing conveyance time of drilling material, thereby resulting in faster vibratory processing.

In another embodiment, permanent magnets 230 or electromagnets 240 may be arranged such that a specified vibratory motion is imparted on basket 220. For example, permanent magnets 230 on one side or end of basket 220 may be arranged to have one polarity pointing downwards while permanent magnets 230 on the opposite side or end of basket 220 are arranged to have the opposite polarity pointing downwards. Thus, one side or end of basket 220 may be attracted to a magnetic field while the other side or end of basket 220 may be repelled to the same magnetic field. Furthermore, permanent magnets 230 or electromagnets 220 may be positioned at angles rather than on strictly upward or downward facing surfaces. Thus, rather than only generating vertical magnetic forces, net magnetic forces may also be generated that have a horizontal force component.

In one or more embodiments of the present disclosure, a retaining system may be used such that a basket is maintained above a skid. Without any type of retaining system, a current applied to an electromagnet may cause the basket to fall off of the skid. For example, referring to FIG. 2, without a retaining system, magnetic forces may cause basket 220 to move toward one side or an end of skid 210 such that permanent magnets 230 are not opposite electromagnets 240, and thereby allowing basket 220 to fall out of a desired orientation with skid 210. Thus, a retaining system may be used to maintain basket 220 in a desired orientation.

Ref erring back to FIG. 4, a retaining system for maintaining a position of vibratory separator 400 is shown. A first frame 470 may be placed on a side of vibratory separator 400. First frame 470 may be substantially U-shaped and placed such that one vertical part is forward of basket spring pad 450, and another vertical part is behind basket spring pad 451. Furthermore, a horizontal part of first frame 470 may span the vertical parts above basket spring pads 450, 451. A second frame 471 may be placed on another side of vibratory separator 400. The retaining system may restrict lateral movement of basket 420, such that during levitation and/or vibration, a side wall of basket 420 comes into contact with first or second frame 470, 471. Additionally, forward, backward, and upward movement of basket 420 may be restricted when basket spring pads 450, 451 come into contact with first or second frame 470, 471. One skilled in the art will appreciate that many different frames may be used such that basket 420 is maintained in a desired orientation. For example, a crossbeam above basket 420 may span between frames on each side of basket 420 to further restrict movement of basket 420.

Furthermore, one skilled in the art will appreciate that other retaining systems may be used to maintain basket 420 in a desired orientation. For example, sidewalls, front walls, and back walls may be disposed around basket 420 in any combination such that movement of basket 420 may be restricted. Alternate retaining systems may include, for example, tethers made of rope, chain, or any other material. Additionally, magnets may be mounted on a retaining system and basket 420 such that a movement of basket 420 may be restricted. Alternatively, springs may be mounted on a retaining system or basket 420 such that basket 420 may be maintained in a desired orientation.

Figure 6:
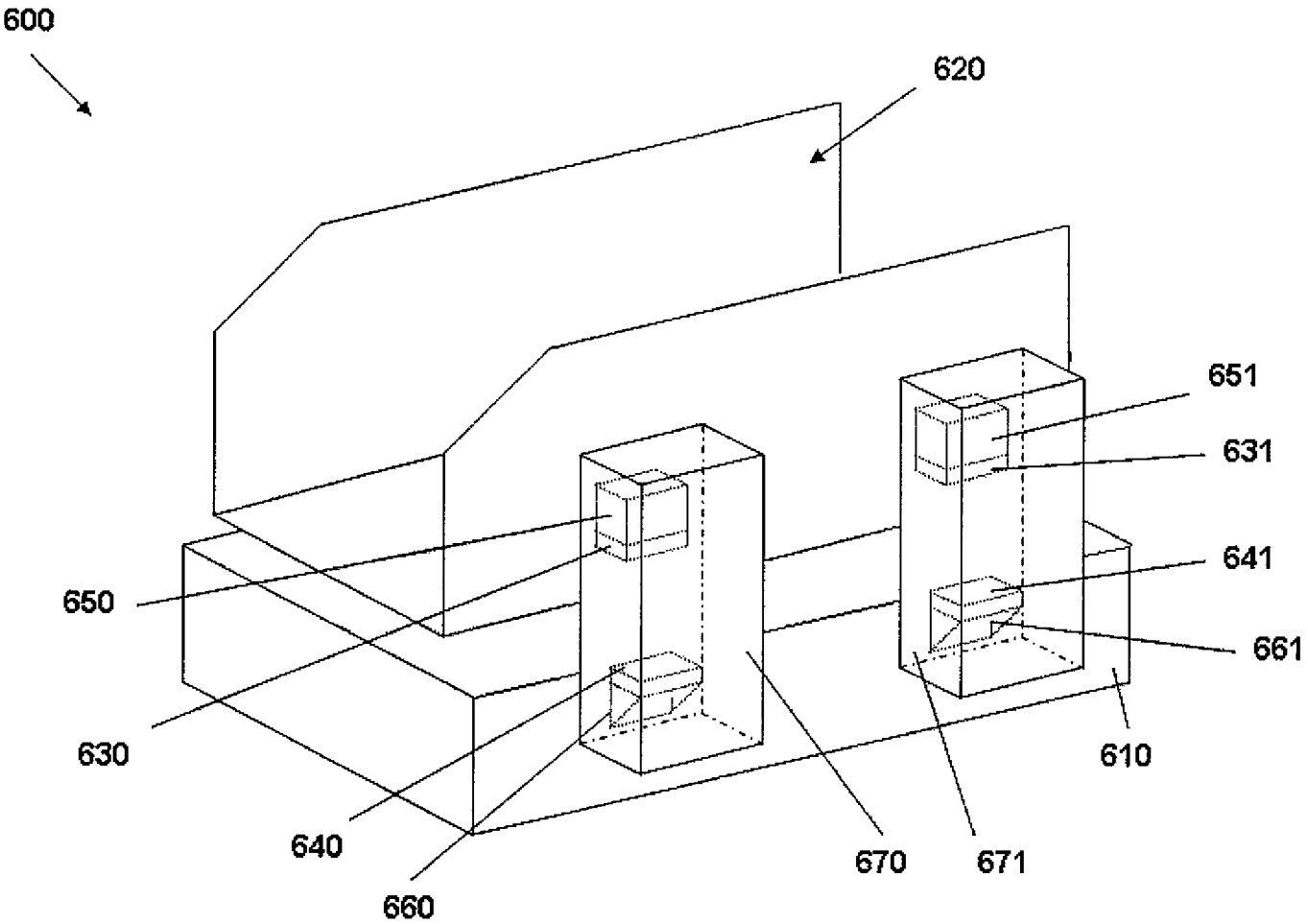
FIG. 6 shows a perspective view of a vibratory separator including a housing in accordance with an embodiment of the present disclosure.

Referring now to FIG. 6, a vibratory separator 600 including an alternate retaining system in accordance with one or more embodiments of the present disclosure is shown. Vibratory separator 600 may include one or more housings substantially enclosing basket spring pads 650, 651, skid spring pads 660, 661, basket magnets 630, 631, and skid magnets 640, 641. Such housings may protect basket magnets 630, 631 and skid magnets 640, 641 from abrasive or corrosive materials. A first housing 670 and a second housing 671 may be connected to skid 610 and skid spring pads 660, 661 such that skid spring pads 660, 661 are stationary relative to first and second housings 670, 671. Alternatively, skid magnets 640, 641 may be mounted on a surface of first and second housings 670, 671 without the need for skid spring pads 660, 661. Furthermore, basket spring pads 650, 651 may be enclosed within, but not connected to, first and second housings 670, 671. Thus, basket 620 may move relative to first and second housings 670, 671, which restrict movement between basket spring pads 650, 651 and first and second housings 670, 671.

Figure 7:
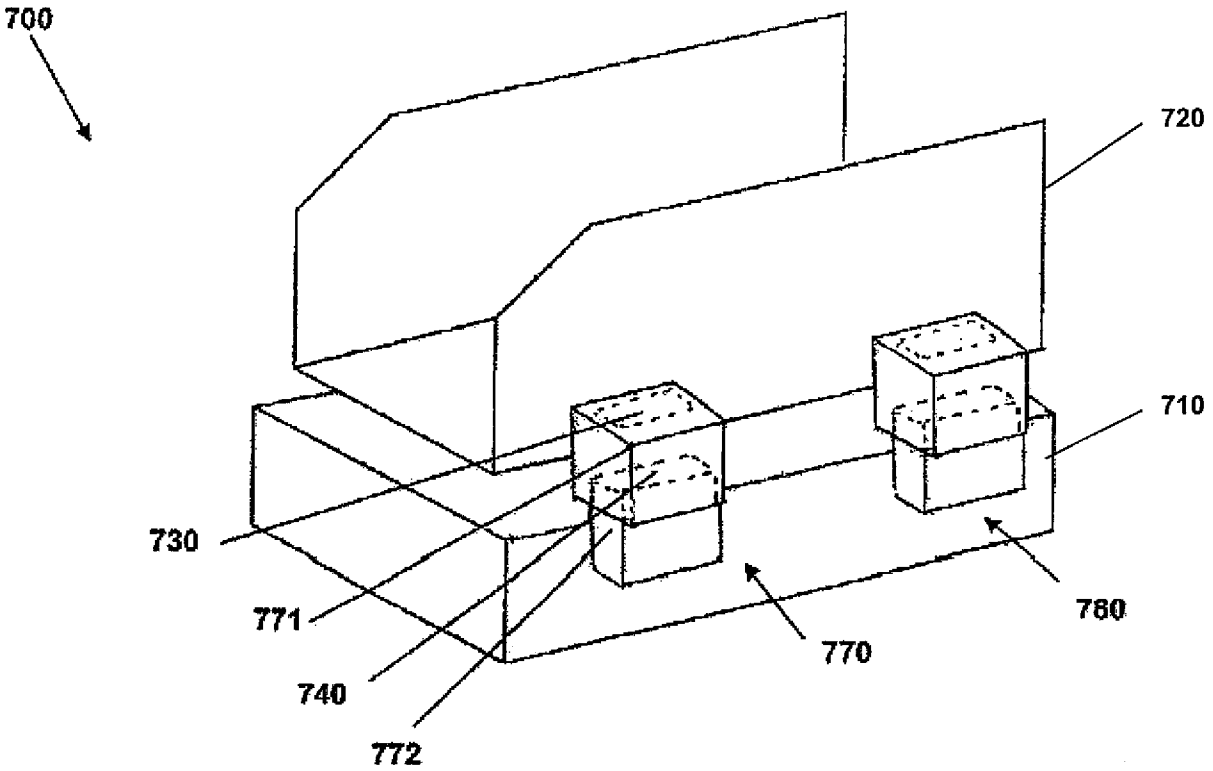
FIG. 7 shows a perspective view of a vibratory separator including a slidable housing in accordance with an embodiment of the present disclosure.

Referring now to FIG. 7, a vibratory separator 700 including another retaining system having one or more housings similar to vibratory separator 600 in accordance with one or more embodiments of the present disclosure is shown. In the embodiment of FIG. 7, a first housing 770 may include two slidably engaging frames mounted on a basket 720 and a skid 710. Specifically, a first housing frame 771 may be disposed on basket 720, and a basket magnet 730 may be mounted on a surface of first housing frame 771. Further, a second housing frame 772 may be disposed on skid 710, and a skid magnet 740 may be mounted on a surface of second housing frame 772. Additionally, second housing frame 772 may have smaller dimensions than first housing frame 771 such that second housing frame 772 may slide within first housing frame 771. Furthermore, a sealing member may be disposed between first and second housing frames 771, 772. A second housing 780 may be similarly disposed adjacent to first housing 770. First and second housings 770, 780 may thus restrict movement of basket 720 while protecting basket magnets 730 and skid magnets 740.

One of ordinary skill in the art will appreciate that retaining systems may be constructed of materials able to withstand certain conditions. For example, referring back to FIG. 4, first and second frames 470, 471 may come into contact with basket 420 during operation of vibratory separator 400. Thus, materials for construction of first and second frames 470, 471 may be chosen for durability and/or pliability. Further, materials may be chosen to add an element of recoil such that if basket 420 contacts first or second frame 470, 471, basket 420 may be bounced away from first or second frame 470, 471. Additionally, materials may be chosen to be temperature, solvent, and abrasion resistant. Such materials may include rubbers or foams. More specifically, materials may include thermoplastic elastomers, polypropylenes, polychloroprenes, polyurethanes, or equivalent materials thereof.

In one or more embodiments of the present disclosure, one or more control systems (e.g., PLC's) may be used to control certain aspects of a vibratory separator. More specifically, one or more control systems may be used to control levitation or vibratory motion of a basket of a vibratory separator. For example, a control system may monitor the position of a basket and control one or more current sources such that the basket is levitated. Furthermore, the addition and removal of drilling material from a basket may cause fluctuations in the mass of a levitated object. Therefore, a control system may control one or more currents such that mass fluctuations may be accounted for. A control system may include position and/or motion sensors to monitor a basket. Such sensors may include photodiodes or transducers. Many control systems are known in the art that may be used in conjunction with embodiments of the present disclosure.

Advantageously, embodiments disclosed herein provide apparatuses and methods for separating drilling material using vibratory separators without springs. As disclosed above, magnets may replace the springs of conventional vibratory separators. The use of springs requires consideration of several problematic issues (e.g., friction, loss of energy, maintenance, and replacement of springs). By replacing the springs with magnets, such issues may be less problematic. For example, in conventional vibratory separators, the springs may be rigid, as the springs must be capable of supporting heavy loads. Thus, imparting vibratory motions to the basket, and in turn the springs, requires a great amount of force. Further, a substantial amount of energy will be lost to friction in the springs. Such rigid structural elements may not be necessary in embodiments disclosed above, and thus, energy loss may be lessened. Furthermore, magnets may require less maintenance and replacement than springs. The magnets may not come into physical contact with other moving parts and may not experience related wear-down. Additionally, electromagnets do not typically lose effectiveness through use. Although permanent magnets may lose magnetization over time, they may easily be replaced or re-magnetized.

Also advantageously, embodiments of the present disclosure may not require the use of motors. In conventional vibratory separators, motors are used to impart a vibratory motion to the vibratory separator. By using magnets instead of motors to impart a vibratory motion, additional costs related to motors may be avoided. Furthermore, by levitating a member of a vibratory separator, embodiments of the present disclosure may have fewer contacting and moving parts than conventional vibratory separators. Contacting and moving parts may wear down over time, requiring further maintenance and replacement. Thus, levitating a member of a vibratory shaker may help to avoid costs related to maintenance and replacement.

Embodiments of the present disclosure may also provide advantages related to shipping. For example, a basket may rest on a skid when a vibratory separator is not in use. During shipping, one or more securing bolts may hold the basket in place, which may be removed upon arrival. In conventional vibratory separators, operators often forget to remove shipping hold downs before beginning operation, which may cause damage to a vibratory separator. In embodiments of the present disclosure, if securing bolts are not removed before use, the current source or another sensor may sense the securing bolts and shut down before any damage is caused.

While the present disclosure has been described with respect to a limited number of embodiments, those skilled in the art, having benefit of this disclosure, will appreciate that other embodiments can be devised which do not depart from the scope of the present disclosure as disclosed herein. Accordingly, the scope of the present disclosure should be limited only by the attached claims.

What is claimed is:

1. A vibratory separator comprising:

a skid comprising at least one side skid magnet disposed on a skid spring pad and located on an upward facing surface of the skid, and at least one laterally offset skid magnet located on the upward facing surface of the skid; and a basket comprising at least one side basket magnet disposed on the basket and located on a downward facing surface of the basket, and at least one laterally offset basket magnet located on a downward facing surface of the basket, wherein the at least one side skid magnet and the at least one side basket magnet are arranged to magnetically interact, and wherein the at least one laterally offset skid magnet and the at least one laterally offset basket magnet are arranged to magnetically interact, wherein interaction between at least one of the at least one side skid magnet and the at least one side basket magnet or the at least one laterally offset skid magnet and the at least one laterally offset basket magnet levitates the basket above the skid such that the basket is structurally unsupported.

2. The vibratory separator of claim 1, wherein the at least one skid magnet and the at least one basket magnet are selected from a group consisting of a permanent magnet and an electromagnet.

3. The vibratory separator of claim 1, wherein a current is applied to at least one of a group consisting of a skid magnet and a basket magnet.

4. The vibratory separator of claim 3, wherein the current is applied by a variable frequency drive.

5. The vibratory separator of claim 4, wherein the variable frequency drive is controlled by a programmable logic controller.

6. The vibratory separator of claim 1, wherein a current is applied to the at least one skid magnet.

7. The vibratory separator of claim 6, wherein the current applied to the at least one skid magnet imparts a vibratory motion to the basket.

8. The vibratory separator of claim 7, wherein the vibratory motion comprises an elliptical motion.

9. The vibratory separator of claim 1, wherein:

the at least one skid magnet comprises a plurality of skid magnets positioned around a periphery of the skid; and the at least one basket magnet comprises a plurality of basket magnets positioned around a periphery of the basket.

10. The vibratory separator of claim 1, wherein the basket further comprises a basket spring pad, wherein the at least one basket magnet is disposed on the basket spring pad.

11. The vibratory separator of claim 1, further comprising a programmable logic controller.

12. The vibratory separator of claim 11, wherein the programmable logic controller comprises vibratory profile instructions.

13. The vibratory separator of claim 1, further comprising a retaining system configured to restrict movement of the basket.

14. The vibratory separator of claim 13, wherein the retaining system comprises a housing configured to substantially enclose the at least one skid magnet and the at least one basket magnet.

15. A vibratory separator comprising:

a skid comprising at least one side skid magnet; and a basket disposed on the skid and structurally uncoupled from the skid, the basket comprising at least one side basket magnet;

wherein the at least one side skid magnet and the at least one side basket magnet are arranged to magnetically interact, and wherein magnetic interaction between the at least one side skid magnet and the at least one side basket magnet levitates the basket such that the basket is lifted off of the skid.

16. The vibratory separator of claim 15, further comprising at least one laterally offset skid magnet and at least one laterally offset basket magnet, wherein the at least at least one laterally offset skid magnet and the at least one laterally offset basket are arranged to magnetically interact.

17. A method for operating a vibratory separator comprising:

supplying a current to a skid electromagnet disposed on a skid spring pad of a skid of the vibratory separator;

interacting the skid electromagnet with a basket magnet disposed on a basket of the vibratory separator; and levitating the basket above the skid such that the basket is structurally disconnected from the skid.

18. The method of claim 17, wherein the current is applied by a variable frequency drive.

19. The method of claim 17, further comprising vibrating the basket while levitating.

20. The method of claim 19, further comprising providing instructions to control the current supplied to the skid electromagnet with a programmable logic controller.

21. The method of claim 20, further comprising defining a vibratory profile with the instructions to control the current.

* * * * *